US007009564B2

(12) United States Patent
Ryken et al.

(10) Patent No.: US 7,009,564 B2
(45) **Date of Patent: *Mar. 7, 2006**

(54) TM MICROSTRIP ANTENNA

(75) Inventors: Marvin L. Ryken, Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 109 days.

This patent is subject to a terminal disclaimer.

(21) Appl. No.: 10/817,412

(22) Filed: Mar. 31, 2004

(65) Prior Publication Data

US 2005/0062648 A1 Mar. 24, 2005

Related U.S. Application Data

(63) Continuation-in-part of application No. 10/664,614, filed on Sep. 19, 2003, now Pat. No. 6,856,290.

(51) Int. Cl.
*H01Q 1/38* (2006.01)

(52) U.S. Cl. ..... 343/700 MS; 343/846; 343/853

(58) Field of Classification Search ..... 343/700 MS, 343/846, 850, 853
See application file for complete search history.

(56) References Cited

U.S. PATENT DOCUMENTS

| | | | | |
|---|---|---|---|---|
| 4,965,605 | A * | 10/1990 | Chang et al. | 343/700 MS |
| 5,455,594 | A * | 10/1995 | Blasing et al. | 343/700 MS |
| 6,329,949 | B1 * | 12/2001 | Barnett et al. | 343/700 MS |
| 6,538,603 | B1 * | 3/2003 | Chen et al. | 342/372 |
| 6,759,980 | B1 * | 7/2004 | Chen et al. | 342/372 |
| 6,856,290 | B1 * | 2/2005 | Ryken et al. | 343/700 MS |

* cited by examiner

*Primary Examiner*—Shih-Chao Chen
(74) *Attorney, Agent, or Firm*—David S. Kalmbaugh

(57) ABSTRACT

A TM microstrip antenna designed to transmit telemetry data for use by a nine inch diameter projectile. The microstrip antenna is configured to wrap around the projectile's body without interfering with the aerodynamic design of the projectile. The TM microstrip antenna operates at 2.25 GHz with a bandwidth of ±10 MHz. Eight microstrip antenna elements equally spaced around the projectile provide for linear polarization and a quasi-omni directional radiation pattern.

20 Claims, 5 Drawing Sheets

TM MICROSTRIP ANTENNA

This application is a continuation-in-part of U.S. patent application Ser. No. 10/664,614, filed Sep. 19, 2003. Now U.S. Pat. No. 6,856,290.

BACKGROUND OF THE INVENTION

1. Field of the Invention

The present invention relates generally to a microstrip antenna for use on a missile or the like. More specifically, the present invention relates to a microstrip antenna which trnsmits telemetry data and which is adapted for use on small diameter projectiles such as a missile.

2. Description of the Prior Art

A microstrip antenna operates by resonating at a frequency. The conventional design for a microstrip antenna utilizes printed circuit board techniques mounting a copper patch on the top layer of a dielectric with a ground plane on the bottom of the dielectric. The frequency at which the antenna operates is approximately a half wavelength in the microstrip medium of dielectric below the copper patch and air above the copper patch.

However, there is a need to isolate the microstrip antenna from radio frequency signals at different frequencies than the operating frequency for the antenna.

To achieve isolation, prior art microstrip antenna designs have used an external filter. This external component requires extra space, which is generally not available on weapons systems, such as small diameter projectiles, and also require interconnecting coaxial cables, which are expensive and not practical when there are severe limitations on available apace in weapons systems.

Accordingly, there is a need for a microstrip antenna which operates in the TM frequency band, requires minimal space, and provides for isolation, protection and amplification. More specifically, there is a need for a TM frequency band microstrip antenna which generates an omni-directional antenna pattern, and provides for a 50 dB isolation from a frequency in the GPS L1 frequency band.

SUMMARY OF THE INVENTION

The present invention overcomes some of the disadvantages of the past including those mentioned above in that it comprises a highly effective and efficient microstrip antenna designed to transmit telemetry data from an approximately nine inch diameter projectile. The microstrip antenna comprising the present invention is configured to wrap around the projectile's body without interfering with the aerodynamic design of the projectile.

The TM Band microstrip antenna operates at 2.25 GHz with a bandwidth of ±10 MHz. Eight microstrip antenna elements equally spaced around the projectile provide for linear polarization and a quasi-omni directional radiation pattern. Each of the eight microstrip antenna elements include a tuning stub on top edge of the element to allow for fine tuning of the element to the operating frequency.

There is a gap around each of the eight antenna elements with the remainder of the antenna covered with copper. The antenna element's electric field is confined generally to the gap. The antenna's feed network consist of equal amplitude and phase power dividers and filters.

The feed network has two identical filters with each filter comprising a band stop filter. The band stop filter is tuned at the GPS L1 frequency so that noise from the TM transmitting antenna elements at the GPS frequency will not increase the noise floor of near-by GPS antenna receiving elements.

DETAILED DESCRIPTION OF A PREFERRED EMBODIMENT

Figure 1A:
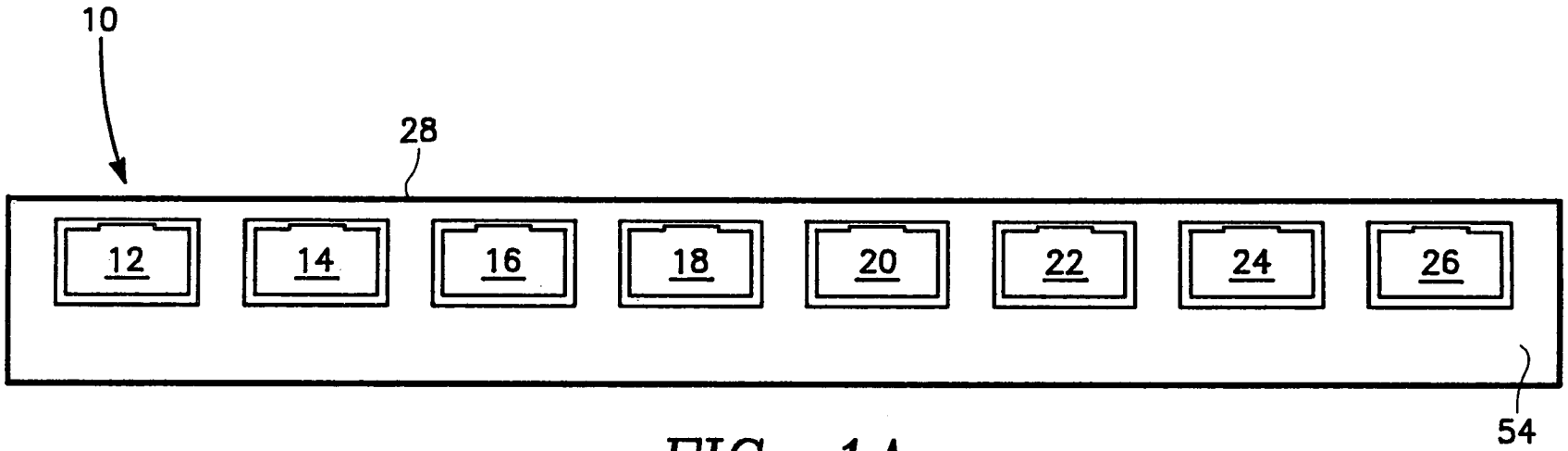
FIG. 1A is a view illustrating the top layer of a circuit board for the TM microstrip antenna comprising the present invention.
Figure 2:
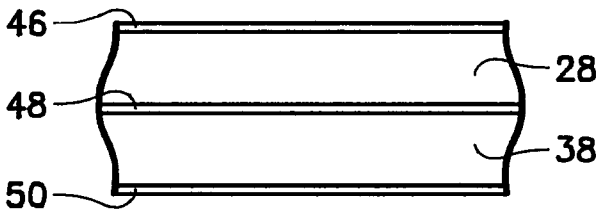
FIG. 2 is a side view of the circuit and ground broads for the TM microstrip antenna of FIG. 1A.

Referring to FIGS. 1 and 2, there is shown a TM microstrip antenna 10 which is a wrap around antenna designed for a small projectile of having a diameter approximately of nine inches. Antenna 10 operates at the TM Band centered at 2.25 GHz with a bandwidth of ±10 MHz. Antenna 10 is linearly polarized and provides for quasi-omni directional radiation pattern coverage.

Referring to FIGS. 1A and 2, microstrip antenna 10 includes eight microstrip antenna elements or rectangular shaped copper patches 12, 14, 16, 18, 20, 22, 24 and 26 which are equally spaced apart and mounted on a circuit board 28. The eight microstrip antenna elements 12, 14, 16, 18, 20, 22, 24 and 26 are positioned around the outer diameter of a nine inch projectile when microstrip antenna 10 is affixed to the projectile.

Figure 1B:
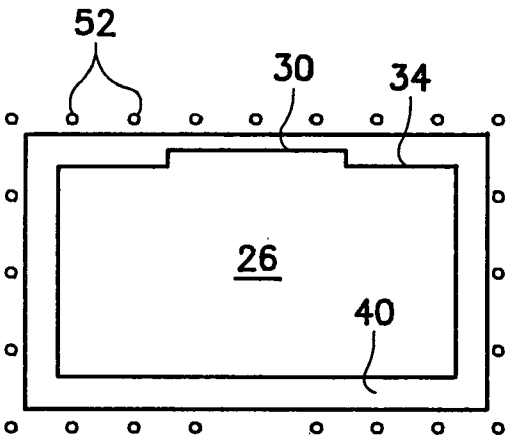
FIG. 1B is an enlarged view depicting one of the eight antenna elements of FIG. 1A including the tuning tab for the antenna element.

Referring to FIGS. 1A and 1B, each of the eight antenna elements 12, 14, 16, 18, 20, 22, 24 and 26 has a tuning stub 30 on the top side 34. The tuning stub 30 for each antenna element 12, 14, 16, 18, 20, 22, 24 and 26 are provided to compensate for manufacturing tolerances and allow for fine tuning of each of the eight antenna elements 12, 14, 16, 18, 20, 22, 24 and 26 to the operating frequency for TM microstrip antenna 10 over approximately 10 MHz.

At this time, it should be noted that the circuit board 28 and a ground board 38 which is positioned below the circuit board 28 are each fabricated from a dielectric. The dielectric used in the preferred embodiment is Duroid 6002 commercially available from Rogers Corporation of Rogers, Conn. The top layer and bottom layer of the circuit board and the bottom layer of the ground board respectively have a one ounce copper plating 46, 48 and 50 with a 0.0014 inch thickness that is etched off to provide the antenna element, feed network and ground patterns illustrated in FIGS. 1A, 3 and 4. The circuit board 28 and the ground board 38 each have overall dimensions of 5.7 inches in width and approximately 27 inches in length.

There is also a four sided gap 40 formed around each side 34, 36, 42 and 44 of the eight antenna elements 12, 14, 16, 18, 20, 22, 24 and 26 of microstrip antenna 10. The four sided gap 40 exposes the top surface of the dielectric 28. The TM microstrip antenna's electric field is confined primarily to the four sided gap 40 around each of the antenna elements which is substantial different than a conventional microstrip copper antenna element where the electric field extends well beyond the antenna element.

Figure 3:
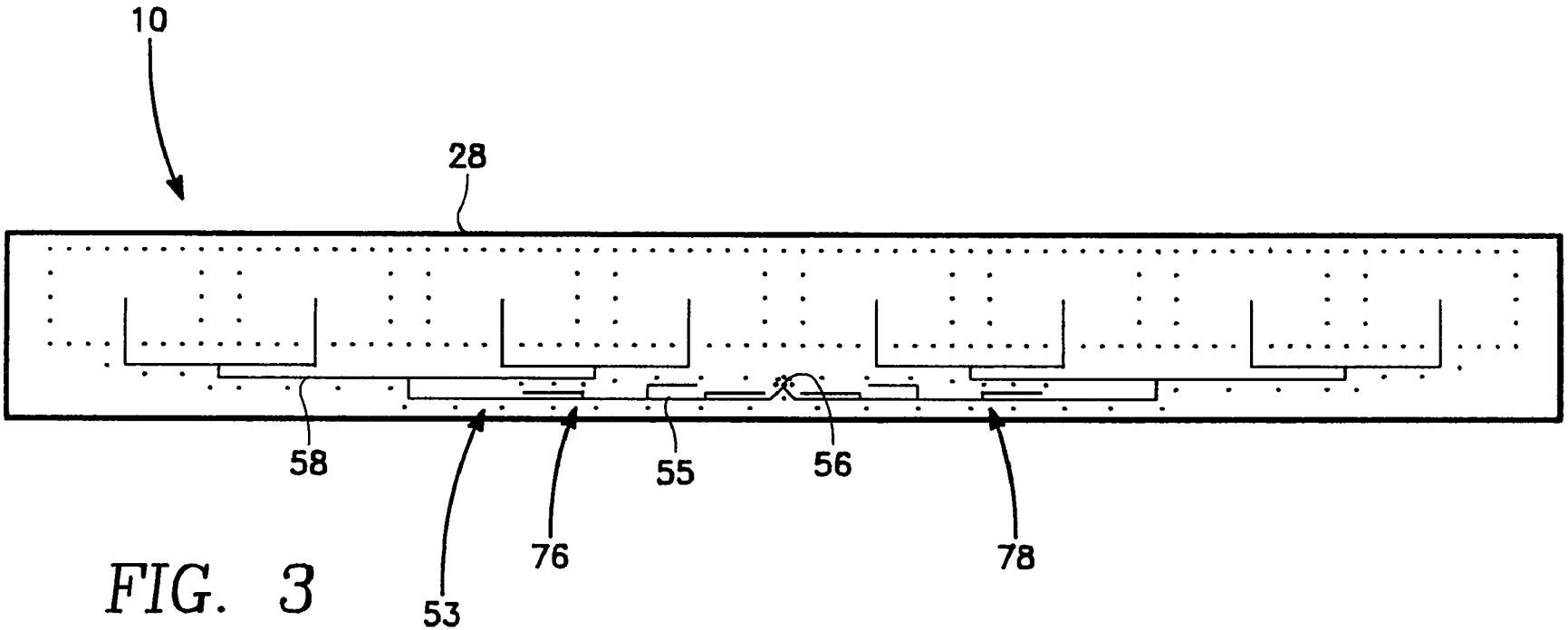
FIG. 3 is a view illustrating the bottom layer of the circuit board for the TM antenna of FIG. 1A.

Referring to FIGS. 1A and 3, each of the antenna elements 12, 14, 16, 18, 20, 22, 24 and 26 is capacitively coupled to a feed network 53 which includes a main transmission line 55, fabricated from etched copper, having one of its ends connected to a fifty ohm signal input 56 for microstrip antenna 10. The feed network 53 operates as an equal amplitude, equal phase power divider providing for equal distribution of RF signals with respect to the eight antenna elements 12, 14, 16, 18, 20, 22, 24, and 26 in both amplitude and phase.

The feed network 53 also includes a plurality of branch transmission lines 58, fabricated from etched copper, which connect the main transmission line 55 to the eight antenna elements 12, 14, 16, 18, 20, 22, 24, and 26.

Each antenna element 12, 14, 16, 18, 20, 22, 24 and 28 is capacitively coupled to one of the branch transmission lines 58 of feed network 53 by a probe 60 which is also an etched copper transmission line. The probes 60 are positioned directly underneath each antenna element 12, 14, 16, 18, 20, 22, 24, and 26 and terminate below each antenna element 12, 14, 16, 18, 20, 22, 24 and 26. Capacitive coupling of the RF signals to the eight antenna elements 12, 14, 16, 18, 20, 22, 24 and 26 from their associated probes 60 is through the dielectric layer 28.

The main feed line 53, branch feed lines 58 and probes 60 are configured such that feed network 53 operates as equal amplitude, equal phase power dividers.

Figure 4:
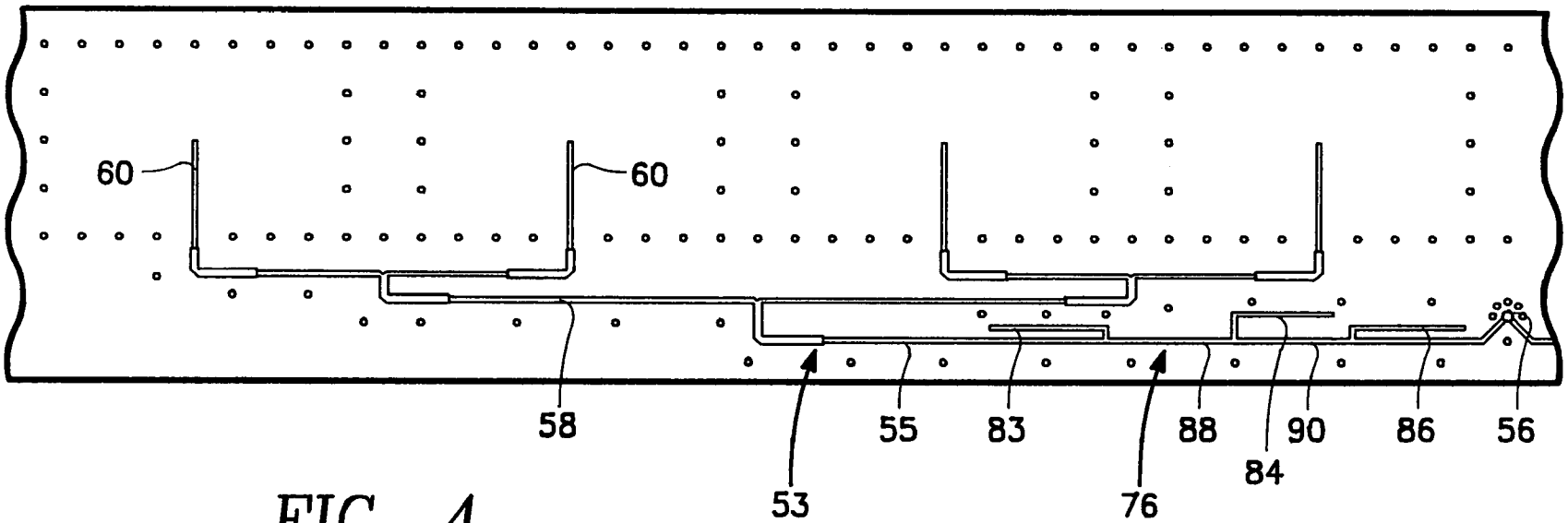
FIG. 4 is an enlarged view of a section of the feed network on the bottom layer of the circuit board including a filter used in the preferred embodiment of the TM microstrip antenna of FIG. 1A.

Referring to FIGS. 3 and 4, FIG. 4 is an enlarged view of a section on the left side of the feed network 53 illustrating in detail a filter 76 which is one of two identical band stop filters 76 and 78 used in the preferred embodiment of the GPS microstrip antenna 10. The other band stop filter 78 is positioned on the right side of the circuit board 28 as shown in FIG. 3.

Band stop filter 76 includes 3 open circuit transmission lines 83, 84 and 86 and two interconnecting transmission lines 88 and 90 which form the five sections of band stop filter 76. Band stop filter 78 is identical to band stop filter 76 in that it is a five section band stop filter. Each filter 76 and 78 is connected to the main transmission line 55 for feed network 53.

Each band stop filter 76 and 78 is tuned at the GPS L1 frequency which is approximately 1.575 GHz. When filters 76 and 78 are tuned at the GPS frequency, noise from the TM transmitting antenna elements at the GPS frequency will not increase the noise floor of near-by GPS antenna receiving elements. A minimum isolation of 50 dB is required and achieved by utilizing the 50 Band stop filters 76 and 78 in the preferred embodiment.

Figure 5:
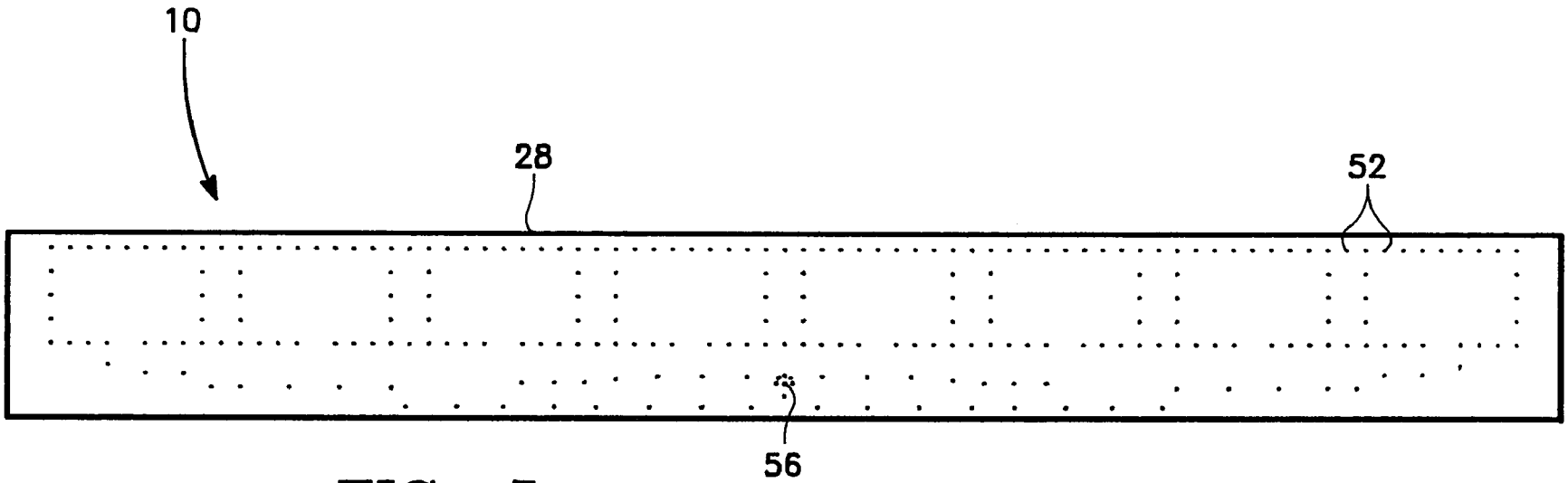
FIG. 5 depicts the layout for the vias/copper plated through holes of the circuit board of FIGS. 1A.
Figure 6:
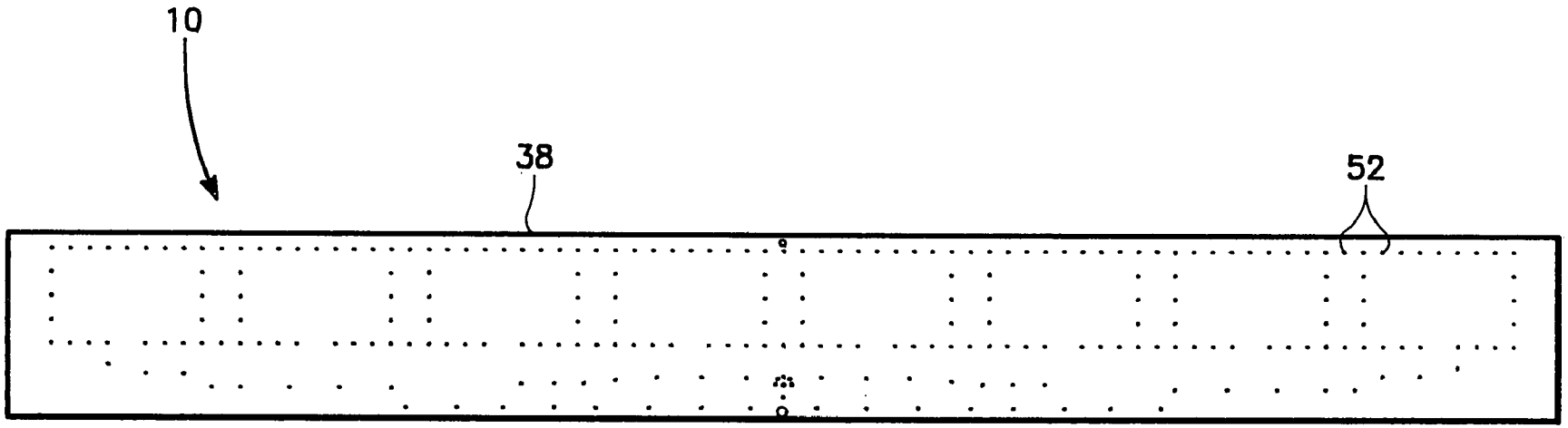
FIG. 6 depicts the top layer of the ground board for the TMS microstrip antenna comprising the present invention.

Referring to FIGS. 1A, 5 and 6, microstrip antenna 10 includes a plurality of plated through holes/vias 52 with the layout for the vias 52 in circuit board 28 being depicted as shown in FIG. 5 and the layout for the vias 52 in ground board 38 being depicted in FIG. 6. The copper region 54 around each of the antenna elements 12, 14, 16, 18, 20, 22, 24 and 26 is maintained at a ground potential by the vias or copper plated through holes 52. Each of the vias 52 passes through the circuit board 28 and the ground board 38 to the copper plated ground plane 50 on the bottom surface of ground board 38. The vias 52 electrically connect the copper region 54 of circuit board 28 to the ground plane 50 of ground board 38.

From the foregoing, it is readily apparent that the present invention comprises a new, unique, and exceedingly useful TM microstrip antenna adapted for use on small diameter projectiles, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A TM microstrip antenna mounted on a projectile comprising:

(a) a first rectangular shaped dielectric layer;

(b) a plurality of rectangular shaped antenna elements mounted on an upper surface of said first dielectric layer, said antenna elements being aligned with one another and fabricated from copper, said antenna elements being adapted to transmit telemetry data at a frequency of approximately 2.25 GHz;

(c) an antenna feed network mounted on a bottom surface of said first dielectric layer, said antenna feed network having a main transmission line connected to a signal input for said TM microstrip antenna, said feed network having a plurality of branch transmission lines connected to said main transmission line and each of said antenna elements, each of said branch transmission lines including a plurality of probes, one of said probes being positioned underneath one antenna element of said plurality of antenna elements to capacitively couple said one antenna element to said feed network, resulting in a linear polarization and an omni-directional radiation pattern being generated by said antenna elements of said TM microstrip antenna; and (d) a pair of identical filters integrally formed within said main transmission line, each of said pair of identical filters being tuned at a GPS frequency of approximately 1.575 GHz to provide for a minimum isolation of 50 dB.

2. The TM microstrip antenna of claim 1 further comprising a continuous gap formed around first, second, third and fourth sides of each of said antenna elements, said continuous gap for each of said antenna elements having an electric field generated by said antenna element confined to said continuous gap.

3. The TM microstrip antenna of claim 2 further comprising a copper plated ground mounted on a remaining portion of the upper surface of said first dielectric layer around the continuous gap for each of said antenna elements.

4. The TM microstrip antenna of claim 3 further comprising a second dielectric layer positioned below said first dielectric layer in alignment with said first dielectric layer, said second dielectric having a ground plane mounted on a bottom surface thereof.

5. The TM microstrip antenna of claim 4 wherein said copper plated ground mounted on the upper surface of said first dielectric layer is connected to the ground plane mounted on the bottom surface of said second dielectric layer by a plurality of vias which pass from said copper plated ground through said first dielectric layer and said second dielectric layer to said ground plane.

6. The TM microstrip antenna of claim 1 wherein said pair of identical filters each comprise a 5-Section Band Stop Filter.

7. The TM microstrip antenna of claim 1 wherein each of said antenna elements includes a tuning stubs located on one side of said antenna element, said tuning stub for each of said antenna element allowing said antenna element to be fine tuned to an operating frequency for said TM microstrip antenna.

8. The TM microstrip antenna of claim 1 wherein said signal input for said feed network comprises a fifty ohm signal input for said feed network.

9. The TM microstrip antenna of claim 4 wherein said first dielectric layer comprises a circuit board and said second dielectric layer comprises a ground board, said circuit board and said ground board each having an overall dimension of 5.7 inches in width and approximately 27 inches in length.

10. A TM microstrip antenna mounted on a projectile comprising:

(a) a first rectangular shaped dielectric layer;

(b) a plurality of rectangular shaped antenna elements mounted on an upper surface of said first dielectric layer, said plurality of antenna elements being aligned with one another and fabricated from copper, said plurality of antenna elements being adapted to transmit telemetry data at a frequency of approximately 2.25 GHz;

(c) each of said plurality of antenna elements including a tuning stub located, on one side of said antenna element, said tuning stub for each of said plurality of antenna elements allowing said plurality of antenna elements to be fine tuned to an operating frequency for said TM microstrip antenna;

(d) an antenna feed network mounted on a bottom surface of said first dielectric layer, said antenna feed network having a main transmission line connected to a signal input for said TM microstrip antenna, said feed network having a plurality of branch transmission lines connected to said main transmission line and each of said antenna elements, each of said branch transmission lines including a plurality of probes, one of said probes being positioned underneath one antenna element of said plurality of antenna elements to capacitively couple said one antenna element to said feed network, resulting in a linear polarization and an omni-directional radiation pattern being generated by said antenna elements of said TM microstrip antenna;

(e) a pair of identical filters integrally formed within said main transmission line, each of said pair of identical filters being tuned at a GPS frequency of approximately 1.575 GHz to provide for a minimum isolation of 50 dB, each of said pair of filters comprising a band stop filter; and (h) a second dielectric layer positioned below said first dielectric layer in alignment with said first dielectric layer, said second dielectric layer having a ground plane mounted on a bottom surface thereof.

11. The TM microstrip antenna of claim 10 further comprising a continuous gap formed around first, second, third and fourth sides of each of said plurality of antenna elements, said continuous gap for each of said plurality of antenna elements having an electric field generated by said antenna element confined to said continuous gap.

12. The TM microstrip antenna of claim 11 further comprising a copper plated ground mounted on a remaining portion of the upper surface of said first dielectric layer around the continuous gap for each of said plurality of antenna elements.

13. The TM microstrip antenna of claim 12 wherein said copper plated ground mounted on the upper surface of said first dielectric layer is connected to the ground plane mounted on the bottom surface of said second dielectric layer by a plurality of vias which pass from said copper plated ground through said first dielectric layer and said second dielectric layer to said ground plane.

14. The TM microstrip antenna of claim 10 wherein said band stop filter for each of said pair of identical filters comprises a 5-Section Band Stop Filter.

15. The TM microstrip antenna of claim 10 wherein said signal input for said feed network comprises a fifty ohm signal input for said feed network.

16. The TM microstrip antenna of claim 10 wherein said first dielectric layer comprises a circuit board and said second dielectric layer comprises a ground board, said circuit board and said ground board each having an overall dimension of 5.7 inches in width and approximately 27 inches in length.

17. A TM microstrip antenna mounted on a projectile comprising:

(a) a first rectangular shaped dielectric layer;

(b) eight rectangular shaped antenna elements mounted on an upper surface of said first dielectric layer, said eight antenna elements being aligned with one another and fabricated from copper, said eight antenna elements being adapted to transmit telemetry data at a frequency of approximately 2.25 GHz;

(c) each of said eight antenna elements including a tuning stub located on one side of said antenna element, said tuning stub for each of said eight antenna elements allowing said eight antenna elements to be fine tuned to an operating frequency for said TM microstrip antenna;

(d) an antenna feed network mounted on a bottom surface of said first dielectric layer, said antenna feed network having a main transmission line connected to a signal input for said TM microstrip antenna, said feed network having a plurality of branch transmission lines connected to said main transmission line and each of said eight antenna elements, each of said branch transmission lines including a plurality of probes, one of said probes being positioned underneath one antenna element of said eight antenna elements to capacitively couple said one antenna element to said feed network, resulting in a linear polarization and an omni-directional radiation pattern being generated by said antenna elements of said TM microstrip antenna;

(e) a pair of identical band stop filters integrally formed within said main transmission line, each of said pair of band stop filters being tuned at a GPS frequency of approximately 1.575 GHz to provide for a minimum isolation of 50 dB; and (h) a second dielectric layer positioned below said first dielectric layer in alignment with said first dielectric layer, said second dielectric layer having a ground plane mounted on a bottom surface thereof.

18. The TM microstrip antenna of claim 17 further comprising a continuous gap formed around first, second, third and fourth sides of each of said eight antenna elements, said continuous gap for each of said eight antenna elements having an electric field generated by said antenna element confined to said continuous gap.

19. The TM microstrip antenna of claim 18 further comprising a copper plated ground mounted on a remaining portion of the upper surface of said first dielectric layer around the continuous gap for each of said plurality of antenna elements.

20. The TM microstrip antenna of claim 19 wherein said copper plated ground mounted on the upper surface of said first dielectric layer is connected to the ground plane mounted on the bottom surface of said second dielectric layer by a plurality of vias which pass from said copper plated ground through said first dielectric layer and said second dielectric layer to said ground plane.

* * * * *